United States Patent [19]

Wyman

[11] Patent Number: 5,064,550

[45] Date of Patent: Nov. 12, 1991

[54] SUPERPARAMAGNETIC FLUIDS AND METHODS OF MAKING SUPERPARAMAGNETIC FLUIDS

[75] Inventor: John E. Wyman, Westford, Mass.

[73] Assignee: Consolidated Chemical Consulting Co., Westford, Mass.

[21] Appl. No.: 535,299

[22] Filed: Jun. 8, 1990

Related U.S. Application Data

[63] Continuation of Ser. No. 357,988, May 26, 1989, abandoned.

[51] Int. Cl.[5] ..... H01F 1/28

[52] U.S. Cl. ..... 252/62.52; 252/62.51

[58] Field of Search ..... 252/62.52, 62.51, 356, 252/74

[56] References Cited

U.S. PATENT DOCUMENTS

| | | | |
|---|---|---|---|
| Re. 32,573 | 1/1988 | Furumura et al. | 252/62.51 |
| 3,712,918 | 1/1973 | Dudzinski et al. | 252/356 |
| 3,758,525 | 9/1973 | Yoshida et al. | 252/356 |
| 4,153,754 | 5/1979 | Huisman | 252/62.52 |
| 4,400,295 | 8/1983 | Ootsu et al. | 252/356 |
| 4,701,276 | 10/1987 | Wyman | 252/62.52 |
| 4,892,798 | 1/1990 | Lamanna et al. | 430/38 |
| 4,956,113 | 9/1990 | Kanno et al. | 252/62.52 |

FOREIGN PATENT DOCUMENTS

| | | | |
|---|---|---|---|
| 3510109 | 9/1986 | Japan | 252/356 |

OTHER PUBLICATIONS

Technical Bulletin for Lubrizol 6418 TM -Dec. 1988.

*Primary Examiner*—Michael Lewis
*Assistant Examiner*—Stephen G. Kalinchak
*Attorney, Agent, or Firm*—Finnegan, Henderson, Farabow, Garrett, Dunner

[57] ABSTRACT

A superparamagnetic fluid having a non-polar hydrocarbon oil carrier liquid and coated magnetic particles coated with at least one acid selected from the group consisting of an organic acid containing only carbon and hydrogen atoms in the chain connected to the carboxyl group, wherein the chain contains at least 19 carbon atoms, and an amino acid acylated with a fatty acid, provided that said organic and amino acids are branched, unsaturated, or both.

A method of making a superparamagnetic fluid, including providing an aqueous suspension of coated magnetic particles coated with at least one acid selected from the group consisting of an organic acid containing only carbon and hydrogen atoms in the chain connected to the carboxyl group, wherein the chain contains at least 19 carbon atoms, and an amino acid acylated with a fatty acid, provided that said orgaic and amino acids are branched, unsaturated, or both. The coated magnetic particles are then separated from water in the aqueous suspension and then dispersed in a non-polar hydrocarbon oil carrier liquid to form a superparamagnetic fluid.

49 Claims, No Drawings

SUPERPARAMAGNETIC FLUIDS AND METHODS OF MAKING SUPERPARAMAGNETIC FLUIDS

This application is a continuation of application Ser. No. 07/357,988 filed May 26, 1989, now abandoned.

FIELD OF THE INVENTION

The present invention is directed to superparamagnetic fluids and to an improved method of making the superparamagnetic fluids.

BACKGROUND OF THE INVENTION

Superparamagnetic fluids and methods of making superparamagnetic fluids are well known in the art and are generally described in Wyman U.S. Pat. Nos. 4,430,239, 4,701,276 and 4,741,850, which are incorporated herein in their entirety. The uses and applications for superparamagnetic fluids are also set forth in these references.

As described in U.S. Pat. No. 4,701,276, a magnetic fluid includes a carrier liquid, a dispersing agent which is a salt of an aromatic sulfonic acid for dispersing coated magnetic particles in the carrier liquid, and magnetic particles coated with at least one organic acid which renders the magnetic particles hydrophobic and which peptizes the magnetic particles into a fugitive carrier liquid which is a solvent for a dispersing agent.

Therefore, formation of the magnetic colloids discussed in U.S. Pat. No. 4,701,276 requires two dispersants, namely a dispersing agent and an organic acid. The organic acid must peptize the magnetic particles into a fugitive carrier which is a solvent for the dispersing agent. Moreover, this method of making a magnetic colloid is unduly complicated because of the additional steps necessitated by the requirement of both a dispersing agent and an organic acid to form stable magnetic colloids.

The present invention provides stable magnetic colloids which are easily produced and which do not require both a dispersing agent and an organic acid.

SUMMARY OF THE INVENTION

To achieve the foregoing objects and in accordance with the purpose of the invention, as embodied and broadly described herein, there is disclosed:

A superparamagnetic fluid comprising:

(a) a non-polar hydrocarbon oil carrier liquid; and (b) coated magnetic particles coated with at least one acid selected from the group consisting of an organic acid containing only carbon and hydrogen atoms in the chain connected to the carboxyl group, wherein the chain contains at least 19 carbon atoms, and an amino acid acylated with a fatty acid, provided that said organic and amino acids are branched, unsaturated, or both.

There is also disclosed a method of making a superparamagnetic fluid comprising the steps of:

(a) providing an aqueous suspension of coated magnetic particles coated with at least one acid selected from the group consisting of an organic acid containing only carbon and hydrogen atoms in the chain connected to the carboxyl group, wherein the chain contains at least 19 carbon atoms, and an amino acid acylated with a fatty acid, provided that said organic and amino acids are branched, unsaturated, or both;

(b) separating said coated magnetic particles from water in said aqueous suspension; and (c) dispersing said coated magnetic particles in a non-polar hydrocarbon oil carrier liquid to form a superparamagnetic liquid.

Additional advantages and embodiments of the invention will be set forth in part in the description which follows, and in part will be apparent from the description, or may be learned by practice of the invention. The advantages of the invention may be realized and attained by processes, materials and combinations particularly pointed out in the appended claims.

DETAILED DESCRIPTION OF THE INVENTION

Based on the disclosure in U.S. Pat. No. 4,701,276, which is fully incorporated herein, it was surprising and unexpected to find that a stable magnetic colloid could be produced in a non-polar hydrocarbon oil without the disclosed dispersing agent—a salt of an aromatic sulfonic acid—when either an organic acid containing only carbon and hydrogen atoms in the chain connected to the carboxyl group, wherein the chain contains at least 19 carbon atoms, or an amino acid acylated with a fatty acid, or a combination of both are used in place of the acid referred to in said patent, provided further that the organic and amino acids are branched, unsaturated, or both. Furthermore, it also was surprising to discover that various combinations of the above acids with other organic acids also produced stable magnetic colloids, without requiring additional dispersing agents which had always been assumed essential, and indeed often are, for the preparation of magnetic colloidal systems.

In accordance with the invention, non-polar hydrocarbon oil carrier liquids useful in the present invention include hydrocarbon oils and preferably poly (alpha olefin) oils of low volatility and low viscosity.

Hydrocarbon oil carrier liquids which are useful in the present invention preferably are those having viscosities ranging from 2 to 20 centistokes, measured at 210° F. When the hydrocarbon oil carrier liquid is a poly (alpha olefin), the oil preferably has a viscosity ranging from 2 to 10 centistokes measured at 210° F.

These hydrocarbon oil carrier liquids are commercially available. For instance, SYNTHANE oils having viscosities of 2, 4, 6, or 8 centistokes (cst) are produced by Gulf Oil Company. Poly (alpha olefin) oils having viscosities of 2, 4, 6, 8, or 10 cst are also available from Quantum Chemical Co.

Magnetic colloids of the present invention may contain any suitable magnetic particles including metals and metal alloys. The magnetic particles most commonly used in magnetic colloids of the present invention are magnetite, gamma iron oxide, chromium dioxide, ferrites, and various elements of metallic alloys. The preferred magnetic particles are magnetite ($Fe_3O_4$) and gamma and alpha iron oxide ($Fe_2O_3$). Magnetic particles are usually present in a magnetic liquid of the present invention from about 1% to 20%, preferably about 1% to 10% and more preferably from about 3% to 8%, by volume of the magnetic colloid.

Magnetic particles present in the final magnetic colloid, such as magnetite, preferably have an average magnetic particle diameter ranging from between about 80 Å to about 90 Å, although particles having larger or smaller average magnetic particle diameters may be used. Commonly used magnetic colloids ordinarily contain magnetic particles with an average magnetic particle diameter of about 105 Å. Although particles having an average magnetic particle diameter of about 105 Å may be used in the present invention, utilizing particles having an average magnetic particle size in the range of from about 80 Å to 90 Å may enhance the apparent stability of magnetic colloids maintained in a magnetic field gradient.

In accordance with the invention, the magnetic particles are coated with at least one acid selected from the group consisting of an organic acid containing only carbon and hydrogen atoms in the chain connected to the carboxyl group, wherein the chain contains at least 19 carbon atoms, and an amino acid acylated with a fatty acid, provided that said organic and amino acids are branched, unsaturated, or both. The structure and properties of branched and unsaturated fatty acids useful in the practice of the invention are described in "Fatty Acids," Vols. 1-5, (K. Markley ed., 2nd ed., 1968).

The organic acid having at least 19 carbon atoms in the chain attached to the carboxyl group may be an aliphatic acid having at least 20 carbon atoms in a linear chain or an aromatic acid having at least 20 carbon atoms in a linear chain.

Preferably, the aliphatic acid is selected from the group consisting of erucic acid, gadoleic acid, 11-eicosenoic acid, cetoleic acid, brassidic acid, selacholeic acid, ximenic acid, lumequeic acid, arachidonic acid, methyl tetracosanoic acid, 20-ethyl docosanoic acid, 2-methyl behenic acid, 2-methyl arachidic acid, 2-methyl cerotic acid and the like.

The aromatic acids useful in accordance with this invention are those acids in which the carbon chain attached to the carboxyl group of an 18 carbon atom or more branched or unsaturated fatty acid is attached to the 2, 3, or 4 position of benzoic acid. Preferably, the aromatic acid is selected from the group consisting of 4-(3-ethyl-8,13-dimethylhexadecyl) benzoic acid, 4-(9-octadecenyl ) benzoic acid, 3-(8-hexadecenyl) benzoic acid and the like.

In accordance with the invention, the amino acid acylated with the fatty acid is represented by formula I:

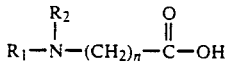

I wherein $R_1$ is a branched or unsaturated fatty acid radical derived from fatty acids with 12 to 22 carbon atoms; $R_2$ is $R_1$, a hydrogen atom or an akyl group with 1 to 22 carbon atoms; and n is an integer of 1 to 11.

Preferably, the fatty acid radical is derived from an acid selected from the group consisting of oleic acid, isostearic acid, erucic acid, linoleic acid, and linolenic acid. More preferably, the amino acid acylated with a fatty acid is oleoyl sarcosine.

In accordance with the present invention, substantially pure acids, i.e., having a purity of 80% or greater, or mixtures of substantially pure acids are preferred. The impurities generally consist of other undesirable fatty acids.

Furthermore, both the organic acid and the amino acid acylated with a fatty acid can be used either separately or in combination, and if utilized in combination, the acids can be present in a mixture in a ratio from greater than 0% to less than 100% by weight.

Moreover, it is possible to combine the organic acid and/or the amino acid acylated with a fatty acid with at least one other acid, for example, oleic acid, linoleic acid, linolenic acid, and isostearic acid. In this case, the amount of oleic acid, linoleic acid, linolenic acid and isostearic acid or combinations thereof may be used in amounts of up to about 90% by weight.

In accordance with the present invention, ashless polymers, also known as "ashless dispersants" throughout the trade, such as Paranox 105 ® and 106 ®, which are lube oil additives containing polyalkenyl succinic anhydride, manufactured by the Exxon Chemical Co., or Lubrizol 6418 ®, manufactured by the Lubrizol Corporation, may be utilized.

The ashless dispersants used in the practice of this invention further increase the apparent colloid stability when it is maintained in a magnetic field gradient. Although the exact mechanism by which this improved stability is achieved is not certain, it is believed that the ashless dispersant, which is a polymer, is absorbed by the dispersed colloidal particles and thus increases the total phase volume of the dispersed magnetic particle, thereby further decreasing particle-to-particle interaction, particularly in a magnetic field gradient. This increased phase volume does, however, increase the viscosity of the colloid when compared to the other colloids of the present invention which are shown in Table 1 below.

The quantity of ashless dispersant used in the practice of this invention can range from about 10% to about 300% by weight of the coating acid. For example, the quantity of ferrous sulfate heptahydrate and ferric chloride is selected so that one mole (231 g) of magnetite is formed. To this is added 50 g of coating acid, for example, erucic acid. Thus, the quantity of ashless dispersant that can be used with this quantity of coated magnetite will range from about 5 g to about 150 g. A representative ashless dispersant, for example, Paranox 105 ® (Exxon Chemical Co.), is supplied as a 50% by weight solution of polymer in mineral oil. Thus, the quantity of Paranox 105 ® that would be used will range from about 10 g to about 300 g with the above cited quantity of coated magnetite.

In a preferred embodiment, it has been found that a magnetic colloid containing magnetic particles covered with erucic acid has excellent stability when exposed to a magnetic field gradient. Although the exact theory why erucic acid coated magnetic particles form excellent magnetic colloids without the addition of a dispersant, such as the salt of the aromatic sulfonic acid disclosed in U.S. Pat. No. 4,701,276, is not well known, it is believed that the erucic acid tail is solvated by the non-polar hydrocarbon oils. In contrast, oleic acid coated particles do not form stable colloids in non-polar hydrocarbon oils because the tails are not believed to be solvated by the hydrocarbon oils. Thus, the above-mentioned aromatic sulfonic acid was essential to the formation of a stable magnetic colloid when only oleic acid or isostearic acid was used as the coating acid.

Moreover, magnetic particles coated with an amino acid acylated with a fatty acid radical of the general formula I:

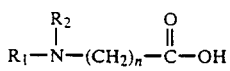

I or a combination of erucic acid and a compound of formula I also produces high quality, stable magnetic colloids. Thus, it would appear that this acid or combination of acids also has its tail solvated by the non-polar hydrocarbon oils.

It is hypothesized that the presence of double bonds or branching in the coating acids introduces an irregularity that prevents close approach of the fatty acid tails which would lead to association of the fatty acid tails with each other and prevent solvation by high molecular weight oils and low molecular weight hydrocarbons, such as heptane. In accordance with the invention, it is necessary that the main chain of the organic acid contain greater than 19 carbon atoms. It is believed that because of the generally spherical nature of the magnetic particle, organic acid tails with greater than about 19 carbon atoms reach further out into the carrier liquid and the ends are further separated, compared with a fatty acid such as oleic acid—which has 17 carbon atoms in the tail and is also unsaturated. The greater separation between the ends provides more space for the larger molecules of the high molecular weight hydrocarbon oil to get between the tails and solvate them.

In accordance with the invention, there is also disclosed a method of manufacturing a super paramagnetic fluid.

In accordance with the method of the present invention, the preferred method of precipitating magnetic particles, in this instance, magnetite, can be described by the following formula:

$$FeSO_4+2FeCl_3+8NH_4OH \rightarrow Fe_3O_4+(NH_4)_2SO_4+6NH_4Cl+4H_2O$$

The stoichiometric ratio of $Fe^{+3}/Fe^{+2}$ is 2:1. It is generally believed that if this ratio is less than 2:1 a considerable quantity of non-magnetic material will be formed. Good yields of magnetic product may be obtained, however, if the molar ratio of $Fe^{+3}/Fe^{+2}$ measured for use in the process of the present invention is about 1.93/1.00. This apparently occurs because a certain amount of ferrous salt is oxidized during normal handling in air. This oxidation reduces the amount of ferrous salt available for reaction and increases the amount of ferric salt. No attempt therefore needs to be made to prevent contact of the ferrous salt with air when solid ferrous salt is weighed and dissolved in the ferric chloride solution. A deliberate excess of ferric salt should be avoided, however, since ferric hydroxide gel may form and might be difficult to wash out of the reaction mixture.

It does not appear necessary to control accurately the rate of addition of the iron salt solution to the ammonia solution. Pouring the iron salt in slowly over about a 30 second time period is usually acceptable. A mixture of ferrous hydroxide and ferric hydroxide gels forms initially. As the mixture is stirred, the gel breaks up, turns black, and the reaction mixture heats up from about 25° C. to about 60° C. Most of the heat is evolved as the mixture of hydrated oxides rearranges to the spinel structure of the magnetite.

The reaction mixture needs to be stirred for only about 15 minutes after complete addition of the iron salts. When the conversion to the spinel structure occurs, usually reaching a final temperature of about 60° C., the lumps of gel disappear in less than 2–3 minutes and a smooth black dispersion of magnetite in water is formed.

In accordance with the invention, the organic acid used to coat the magnetic material can be added in one of two ways. If one acid alone is used, such as erucic acid, the organic acid can be added to the vortex formed by rapid mechanical stirring of the reaction mixture. Then, stirring for an additional fifteen minutes allows the organic acid to dissolve in the ammoniacal solution so that it is transported through the aqueous medium to deposit on the surface of the magnetic material.

Alternatively, if a combination of acids is used, such as erucic acid and oleoyl sarcosine, the acids are preferably first melted and mixed together and then dissolved in strong aqueous ammonia. The resulting ammonium soap solution is heated to about 90° C. and then added to the magnetic slurry. This procedure ensures that there is no preferential deposition of one acid at the expense of another.

In accordance with the invention, the coated magnetic particles are then separated from the aqueous solution by a separation process. The separation process may include a settling and siphoning step followed by removal of the coated magnetic particles. The settling may occur either naturally, by gravity, or assisted by a magnet placed beneath the beaker.

In a preferred embodiment, a predetermined amount of a non-polar organic liquid fugitive carrier, such as heptane, is added to aid in getting the acid coated magnetic particles out of the water. In accordance with the invention, other fugitive carriers that may be used are selected from the group consisting of hexane, kerosene, benzene, toluene, xylene, and the like.

Separating the coated magnetic particles from water as thoroughly as possible is important to the practice of the present invention in order to prevent catalyzed oxidation of the magnetite to ferric oxide. Stirring the reaction mixture with the correct quantity of fugitive carrier for about 10–15 minutes causes the coated magnetite to settle to the bottom of the beaker.

A skilled artisan can readily determine the predetermined amount of a liquid fugitive carrier to be added by experimentation. More specifically, the correct quantity of fugitive carrier is the amount which causes the coated magnetite to coagulate into a water repellant granular mass.

For example the predetermined amount of heptane added to remove the acid coated magnetic particles from water is about 50 to 55 cc per mole of coated magnetite. Addition of too much heptane will cause the formation of a viscous oily mass which emulsifies some of the reaction mixture with the by-product salts which are then extremely difficult to wash out. Too little heptane produces a light, powdery mass which is slow to settle even under the influence of a magnet.

In accordance with the invention, the separated coated magnetite is then washed. Placing a large Alnico 5 horseshoe magnet along the side of the beaker holds the coated magnetite in place as the beaker is tipped to allow the water to run out. The aqueous phase is removed almost completely, and the beaker is refilled with water and stirred before it is drained again. Experience has shown that usually three washes is adequate to remove impurities. Any excess ferric hydroxide gel tends to absorb on the coated magnetite particles. However, the excess ferric hydroxide is washed off the particles by the rinse water and appears to remain suspended in the rinse water long enough to be drained out of the beaker. As a rule, three water washes are sufficient but in any event, washing should be continued until the rinse water is clear and free from suspended solids.

The coated particles at this point ordinarily still contain some water. In a preferred embodiment, most of the remaining water can be easily removed by stirring the particles with a water miscible solvent, such as acetone, methanol, ethanol, and the like. The magnetic particles are then collected over a magnet and as much of the water miscible solvent as possible is drained off. Preferably, two sequential water miscible solvent washes are used. The addition of the water miscible solvent effectively removes almost all of the water before the addition of a large quantity of the non-polar hydrocarbon carrier liquids which are immiscible with water. The process outlined above eliminates problems, such as emulsification, which are encountered when the carrier liquids are added directly to the coated magnetic particles suspended in water or the aqueous reaction mixture.

In accordance with the invention, a non-polar hydrocarbon liquid carrier or more preferably a mixture of the hydrocarbon liquid carrier and a fugitive carrier, such as heptane, is then added to the coated particles to form a slurry. The slurry is then heated to evaporate any residual water and water miscible solvent. The resulting slurry is then placed in a shallow nonmagnetic pan over a strong magnet for about one hour to remove particles which are too large to be stabilized by the coating acids.

The refined magnetic colloid in liquid carrier is removed from the pan without taking the pan off the magnet. As much of the liquid as possible is scooped out by a small beaker and filtered, preferably through a bed of diatomaceous earth into a pan. The residual material is washed up to 5 times with 200 ml portions of a fugitive carrier. Unstabilized particles are held strongly on the bottom of the pan by the magnet. Any residual stable magnetic colloid is diluted by the fugitive carrier so that it is only weakly held by the magnet and can be poured out of the pan. The coated magnetic particles form a stable colloid in the carrier liquid/fugitive carrier mixture and are now free from large, unstable particles as well as any inorganic salt byproduct which might not have been eliminated by water washing.

The viscosity of a magnetic fluid is a property which is preferably controlled since viscosity affects the suitability of magnetic fluids for particular applications. The viscosity of a magnetic fluid may be predicted by principles used to describe the characteristics of ideal colloids which follow the Einstein relationship defined by the following formula:

$$(N/N_o)=1+\alpha\phi$$

wherein:

$N$=colloid viscosity;

$N_o$=carrier liquid viscosity $\alpha$=a known constant; and $\phi$=disperse phase volume.

The saturation magnetization of magnetic fluids is a function of the disperse phase volume of magnetic material in the magnetic fluid. In magnetic fluids, the actual disperse phase volume is equal to the phase volume of magnetic particles plus the phase volume of the attached dispersant.

In the invention discussed in U.S. Pat. No. 4,701,276, the viscosity of the magnetic fluid was minimized by minimizing the actual disperse phase volume relative to the volume of magnetic material. In other words, to obtain a low viscosity colloid in accordance with the invention in said patent, it was necessary to maximize the magnetic particle volume relative to the total disperse phase volume. This objective was achieved primarily by designing a dispersing agent with a tail portion of desired size. Particle size distribution cannot be ignored, however.

For example, when using the dispersants in said patent to form magnetic fluids in non-polar hydrocarbon oil carrier liquids, in particular a 6 cst poly (alpha olefin) oil, magnetic fluids with the following characteristics were prepared: a magnetic fluid having a saturation magnetization of 200 gauss and a viscosity at 27° C. of 78.5 centipoise (cp); a magnetic fluid with a saturation magnetization of 250 gauss and a viscosity at 27° C. of 91.5 cp; a magnetic liquid with saturation magnetization of 300 gauss and a viscosity at 27° C. of about 111 cp; and a magnetic fluid with a saturation magnetization of 400 gauss with a viscosity at 27° C. of about 172 cp; and a magnetic fluid with a saturation magnetization of 482 gauss with a viscosity at 27° C. of about 276 cp.

The colloids produced according to the practice of the present invention are superior to those colloids produced according to the invention disclosed in U.S. Pat. No. 4,701,276 because the viscosity of the colloids produced by the practice of this invention is lower than the viscosity of the colloids produced according to said patent when compared at equivalent phase volume of magnetic material. This superiority, in part, may be attributed to the fact that the dispersants used in the colloids of the present invention are more effective than the dispersants used in manufacture of the colloids in U.S. Pat. No. 4,701,276. Table 1 below compares the viscosities of the colloids at near equivalent magnetic particle phase volumes.

TABLE 1

Comparison of Magnetization/Viscosity Values of Superparamagnetic Liquids Using a 6 cst Oil Carrier

| Colloids of U.S. Pat. No. 4,701,276 (Oleic Acid/"Petrosul 750") | Colloids of Present Invention (Erucic Acid) |
|---|---|
| * 200/78.5 | 198/65 |
| 250/91.5 | 257/71 |
| 300/111 | 292/79 |
| 400/172 | 416/103 |
| 482/276 | 484/123 |

* The number to the left of the slash is the value of saturation magnetization at infinite field. The number to the right of the slash is the viscosity of the superparamagnetic liquid in centipoise measured at 27° C.

As shown above in Table 1, the viscosities of the colloids of the present invention are substantially lower than corresponding viscosities for the colloids produced according to U.S. Pat. No. 4,701,276.

In many sealing operations which utilize a magnetic colloid sealing system, it is advantageous to have a magnetic colloid with the lowest possible viscosity to reduce frictional heating which in turn reduces the evaporation rate of the carrier liquid, thereby prolonging the life of the seal. Moreover, the magnetic colloid having the lower viscosity at an equivalent magnetization value will often show greater stability when it is maintained in a static condition in a magnetic field gradient. The lower viscosity of the magnetic colloids produced according to the present invention is believed to be a result of weaker particle-to-particle interactions.

The invention is described further by means of the following examples, illustrating preferred embodiments of the invention. The examples should in no way be considered limiting, but are merely illustrative of the various features of the present invention.

EXAMPLE 1

Preparation of a Super Paramagnetic Liquid Using Erucic Acid as the Sole Dispersant In a four liter beaker was placed 278 g of ferrous sulfate heptahydrate, 400 ml of water, and 470 ml of 42° Baume ferric chloride solution. The mixture was stirred and heated to dissolve the iron salt.

In a 4 liter beaker was placed 600 ml of 26° Baume ammonia and 400 ml of water. The iron salt solution was added with vigorous stirring and stirring was continued for 10 minutes until a smooth suspension of magnetite was formed. The beaker containing the magnetite slurry was placed on a hot plate and stirred and heated to 70° C. A total of 50 g of erucic acid was added and stirring and heating was continued for an additional 20 minutes.

The beaker was removed from the hot plate and 1 liter of cold water was added. A quantity of 54 ml of heptane was added and stirring was continued for 10 minutes to cause the coated magnetite to coagulate. The coated magnetite was then washed by decantation six times with cold water. The solids were then washed twice with 750 ml portions of acetone, and the acetone was allowed to drain out completely.

The coated magnetite was placed in an enameled pan, and the beaker was rinsed with two 250 ml portions of heptane which was added to the coated magnetite contained in the enameled pan. A quantity of 200 g of a 6 cst poly (alpha olefin) oil was added to the coated magnetite and the mixture was heated on a hot plate to 125° C. to evaporate acetone and excess heptane. The liquid in the pan was cooled to approximately 70° C. and then placed in an aluminum pan over an Alnico 5 magnet. The pan was rinsed with an additional 500 cc of heptane which was added to the liquid in the aluminum pan over the magnet.

The magnetite suspension in the poly (alpha olefin) oil/heptane mixture was held over the magnet for one hour and then it was filtered through a bed of diatomaceous earth into the enameled pan. Without removing the aluminum pan from the magnet, the solids in the pan were washed with four consecutive 200 ml portions of heptane, each portion of heptane being poured out of the pan through the diatomaceous earth filter. The liquid in the enameled pan was then heated strongly to an internal temperature of 130° C. to 135° C. and maintained at this temperature for 45 minutes with air blowing over the surface of the liquid to complete the evaporation of heptane.

The colloid was then poured into a shallow aluminum pan and placed over an Alnico 5 magnet in an oven heated to 70° C. and allowed to remain there for 12 hours. The pan was removed from the magnet and the liquid was quickly poured from the pan into a filter, leaving behind a small amount of solid agglomerated particles. The yield was 280 ml of filtered fluid with a saturation magnetization of 484 gauss at infinite field. The magnetization value of the fluid was 465 gauss at an applied field of 8 kOe.

EXAMPLE 2

Preparation of a Superparamagnetic Fluid Utilizing an Ashless Dispersant

In a four liter beaker was placed 278 g of ferrous sulfate heptahydrate, 470 ml of 42° Baume ferric chloride solution, and 400 ml of water. The mixture was heated and stirred to dissolve the iron salt.

In a four liter beaker was placed 600 ml of 26° Baume ammonia and 400 ml of water. With vigorous stirring, the iron salt solution was added and stirring was continued until a smooth slurry of magnetite was formed. The beaker was placed on a hot plate and stirred and heated to about 70° C. A quantity of 50 g of erucic acid was added, and stirring was continued for about 20 minutes to form a smooth slurry of erucic acid coated magnetite.

The beaker was removed from the hot plate and one liter of cold water was added. The slurry was stirred while 54 ml of heptane was added, and stirring was continued for 15 minutes. The coated magnetite was collected by placing the beaker on a large Alnico 5 magnet. The aqueous phase was drained and the magnetite was washed six times with cold water, then twice with 750 ml portions of acetone. The acetone was allowed to drain as completely as possible from the beaker.

The coated magnetite was placed in a enameled pan with 500 ml of xylene, and the beaker was rinsed twice with 250 ml portions of heptane which was added to the magnetite contained the enameled pan. The mixture was heated to 120° C. in a stream of air to evaporate water, acetone and excess heptane. Then the slurry was placed in a shallow aluminum pan over an Alnico 5 magnet. The slurry was allowed to stand undisturbed for one hour.

A total of 95 g of an ashless dispersant ("Paranox 105" from Exxon Corporation) was placed in an enameled pan. The erucic acid coated magnetite suspended in the xylene/heptane mixture was filtered through diatomaceous earth into the pan containing the ashless dispersant. Without removing the aluminum pan from the magnet, the solids were washed with four consecutive 200 ml portions of heptane, each portion of heptane being poured out of the pan and through the diatomaceous earth filter.

The mixture in the enameled pan was heated in a stream of air to 130° C. to evaporate heptane. The liquid was poured into a beaker and the pan rinsed with heptane which was combined with the liquid in the beaker. After cooling to about 50°, the liquid was stirred and an equal volume of acetone was added. The agglomerated solids were attracted to the side of the beaker by an Alnico 5 magnet, and the liquid was poured out of the beaker. The residue in the beaker was titrated with an additional 900 ml of acetone. The solid material was again attracted to the side of the beaker by an Alnico 5 magnet and the acetone was again allowed to drain from the beaker as completely as possible.

The coated magnetite was placed in an enameled pan containing 360 grams of 6 cst poly (alpha olefin) oil and about 500 ml of heptane. The mixture was stirred with gentle heating until all the solids had gone into suspension, then it was heated strongly to about 140° C. in a stream of air to evaporate the heptane. The superparamagnetic liquid was placed in a pan over an Alnico 5 magnet in a 70° C. oven for 12 hours.

The pan was removed from the magnet and the liquid was quickly filtered. A yield of 500 ml of superparamagnetic liquid with a magnetization value of about 291 gauss and a viscocity of 90 cp at 27° C. was obtained.

EXAMPLE 3

Preparation of a Super Paramagnetic Fluid Using Oleoyl Sarcosine as a Dispersant In a 600 ml beaker was placed 50 grams of oleoyl sarcosine ("Hamposyl O," W. R. Grace Co.), 300 ml of water, and 100 ml of ammonia solution. The mixture was stirred and heated until a clear solution was formed.

In a four liter beaker was placed 278 grams of ferrous sulfate heptahydrate, 400 ml of water, and 470 ml of 42° Baume ferric chloride solution. The mixture was warmed and stirred to dissolve the iron salt. In a four liter beaker was placed one liter of 26° Baume ammonia solution and with vigorous stirring, the iron salt solution was added. Stirring was continued until a smooth slurry of magnetite was formed. The oleoyl sarcosine solution was added with vigorous stirring for about 10 minutes, then 53 ml of heptane was added and stirring was continued for 10 minutes.

With continued stirring, six molar sulfuric acid was added until the odor of ammonia could no longer be detected. The coated magnetite was coagulated and collected by a magnet held at the side of the beaker. The aqueous phase was decanted, and the solids were washed three times with cold water by decantation.

The solids were then washed twice with 750 ml portions of acetone, the acetone drained as completely as possible, and the residue was poured into an enameled pan. The beaker was rinsed with heptane to remove all of the coated magnetite and this was also added to the coated magnetite in the enameled pan.

A quantity of 200 grams of 6 cst poly (alpha olefin) oil was added to the solids in the pan and the mixture was heated to 140° C. in a stream of air to remove excess acetone, heptane, and water. The fluid in the pan was cooled to approximately 70° C., diluted with an equal volume of heptane, and placed in a pan over an Alnico 5 magnet. It was allowed to stand over the magnet for one hour at room temperature.

The liquid in the pan over the magnet was filtered through diatomaceous earth and without removing the pan from the magnet, the solids were washed with three consecutive 200 ml portions of heptane.

The combined filtrate and washings were heated in a stream of air to 140° C. to evaporate heptane, and the fluid was placed in a shallow pan over an Alnico 5 magnet in a 70° C. oven for 12 hours.

The pan was quickly removed from the magnet and the fluid poured through a filter. About 200 ml of a stable super paramagnetic liquid was obtained.

EXAMPLE 4

Preparation of a Superparamagnetic Fluid Utilizing Isostearoyl-6-Aminocaproic Acid In a four liter beaker was placed 400 ml of water, 278 grams of ferrous sulfate heptahydrate and 470 ml of 42° Baume ferric chloride solution. The mixture was warmed and stirred to dissolve the iron salts.

In a one liter beaker was placed 75 grams of isostearoyl-6-aminocaproic acid, 500 ml of water, and 100 ml of 26° Baume ammonia solution. The mixture was stirred and heated to dissolve the acid.

In a four liter beaker was placed one liter of 26° Baume ammonia and with vigorous stirring, the iron salt solution was added. The mixture was stirred until a smooth black free-flowing slurry of magnetite was formed, then the solution of the isostearoyl-aminocaproic acid was added and stirring continued for 30 minutes. A total of 55 ml of heptane was added and stirring was continued for 10 minutes. With stirring, six molar sulfuric acid was added until the smell of ammonia could no longer be detected.

The solids were collected at the side of the beaker by a magnet and the aqueous phase was decanted. The mixture was washed three times with three liter portions of cold water. The solids were then washed three times with 1500 ml portions of acetone.

The acetone dried solids were placed in an enameled pan with 200 grams of 6 cst oil and the mixture was warmed in a stream of air to evaporate the acetone. The beaker was rinsed with a 500 ml portion of heptane which was added to the colloid in the enameled pan, the mixture was placed in an aluminum pan over the Alnico 5 magnet and allowed to stand undisturbed for 12 hours.

The liquid in the pan was filtered through diatomaceous earth, and the residue in the pan was washed three times with 200 ml portions of heptane without removing the pan from the magnet. The heptane filtrate was combined with the original material and the fluid was heated to 140° C. in a stream of air to evaporate heptane. The colloid was then placed in a shallow aluminum pan over an Alnico 5 magnet in a 70° C. oven for 12 hours.

The pan was removed from the magnet and the liquid quickly poured out through a filter. A stable superparamagnetic liquid with a magnetization of about 280 gauss was obtained.

EXAMPLE 5

Preparation of a Superparamagnetic Colloid Utilizing Isostearic And Behenic Acids In a 4 liter beaker was placed 278 grams of ferrous sulfate heptahydrate, 400 ml of water, and 470 ml of 42° Baume ferric chloride solution. The mixture was warmed and stirred to dissolve the iron salt.

In a 1 liter beaker was placed 7.5 grams of behenic acid (Hystrene 9022, Witco Chem. Co.) and 42.5 grams of isostearic acid (Emersol 875, Quantum Chemical Co.). The mixed acids were heated to melt them, then 500 ml of water was added and heated with stirring to about 60° C. A total of 100 ml of 26° Baume ammonia was added and the mixture was stirred to dissolve the mixed acids.

In a 4 liter beaker was placed 1 liter of 26° Baume ammonia, and with vigorous stirring, the iron salt solution was added. Stirring was continued for 15 minutes until a smooth, uniform slurry of magnetite was formed.

The hot solution of the mixed acids was added and stirring was continued for 10 minutes. A total of 54 ml of heptane was added and stirring was continued for 10 minutes to coagulate the coated magnetite.

The coated magnetite was held at the side of the beaker by an Alnico 5 magnet and the aqueous phase was drained out. The coated magnetite was washed 5 times with 3 liter portions of cold water, then three times with 800 ml portions of acetone.

The acetone was drained carefully, then the solids were placed in an enameled pan with one liter of heptane and heated to 96° C. in a stream of air to evaporate residual water and acetone.

The mixture was cooled to 70° C., then poured into an aluminum pan placed over an Alnico 5 horseshoe magnet for 1 hour. The liquid was filtered through diatomaceous earth and the residue in the pan was washed with four two hundred ml portions of heptane without removing the pan from the magnet. The washings were also filtered through a diatomaceous earth filter.

The heptane suspension of coated magnetite and the washings were combined in an enameled pan and 190 grams of a 6 cst poly (alpha olefin) oil was added. The mixture was heated in a stream of air to 140° C. to evaporate heptane. The liquid was placed in an aluminum pan over an Alnico 5 magnet in a 70° C. oven for 12 hours. The pan was removed from the magnet and the liquid was quickly filtered. A superparamagnetic liquid with a saturation magnetization value of 444 gauss and a viscosity of 128 cp at 27° was obtained.

EXAMPLE 6

Preparation of a Superparamagnetic Fluid Utilizing Erucoyl Glycine

Following the procedure described in Example 4, a magnetic colloid in a 6 cst oil is prepared using erucoyl 2-aminoacetic acid as the coating acid for the magnetite.

EXAMPLE 7

Preparation of a Superparamagnetic Fluid Utilizing Erucoyl Sarcosine

Following the procedures described in Example 4, a magnetic colloid is prepared in a 6 cst poly (alpha olefin) oil using erucoyl sarcosine as the coating acid for the magnetite.

EXAMPLE 8

Preparation of a Superparamagnetic Fluid Utilizing Oleoyl 6-Aminocaproic Acid Following the procedure described in Example 4, a magnetic colloid is prepared in a 6 cst poly (alpha olefin) oil utilizing oleoyl 6-aminocaproic acid as the coating acid for magnetite.

EXAMPLE 9

Preparation of a Superparamagnetic Fluid Utilizing Oleoyl 4-Aminobutyric Acid Following the procedure described in Example 4, a magnetic colloid is prepared in a 6 cst poly (alpha olefin) oil utilizing oleoyl 4-aminobutyric acid as the coating acid for magnetite.

What is claimed is:

1. A superparamagnetic fluid in a stable colloid form comprising:

(a) a non-polar hydrocarbon oil carrier liquid;

(b) magnetic particles coated with at least one acid selected from the group consisting of an organic acid containing only carbon and hydrogen atoms in the chain connected to the carboxyl group, wherein the chain contains at least 19 carbon atoms, and an amino acid acylated with a fatty acid, provided that said organic and amino acids are branched, unsaturated, or both; and (c) an ashless polymer which increases the viscosity of said superparamagnetic fluid.

2. The superparamagnetic fluid according to claim 1, wherein said organic acid is an aliphatic acid having at least 20 carbon atoms in a linear chain.

3. The superparamagnetic fluid according to claim 1, wherein said organic acid is an aromatic acid having at least 20 carbon atoms in a linear chain.

4. The superparamagnetic fluid according to claim 2, wherein said aliphatic acid is selected from the group consisting of erucic acid, gadoleic acid, 11-eicosenoic acid, cetoleic acid, brassidic acid, selacholeic acid, ximenic acid, lumequeic acid, arachidonic acid, methyl tetracosanoic acid, 20-ethyl docosanoic acid, 2-methyl behenic acid, 2-methyl arachidic acid and 2-methyl cerotic acid.

5. The superparamagnetic fluid according to claim 3, wherein said aromatic acid is selected from the group consisting of 4-(3-ethyl-8,13-dimethylhexadecyl) benzoic acid, 4-(9-octadecenyl) benzoic acid, 3-(8-hexadecenyl) benzoic acid.

6. The superparamagnetic fluid according to claim 1, wherein said amino acid acylated with a fatty acid is represented by formula I:

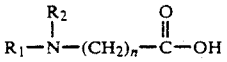

$$R_1-\overset{\overset{R_2}{|}}{N}-(CH_2)_n-\overset{\overset{O}{\|}}{C}-OH \qquad \text{I}$$

wherein $R_1$ is a branched or unsaturated fatty acid radical derived from fatty acids with 12–22 carbon atoms; $R_2$ is $R_1$, a hydrogen atom or an alkyl group with 1 to 22 carbon atoms; and n is an integer of 1 to 11.

7. The superparamagnetic fluid according to claim 6, wherein said fatty acid radical is derived from an acid selected from the group consisting of oleic acid, isostearic acid, erucic acid, linoleic acid and linolenic acid.

8. The superparamagnetic fluid according to claim 6, wherein said amino acid acylated with a fatty acid is oleoyl sarcosine.

9. The superparamagnetic fluid according to claim 1, wherein said ashless polymer is used to increase the apparent colloid stability in a magnetic field gradient.

10. The superparamagnetic fluid according to claim 1, wherein said non-polar hydrocarbon oil carrier liquid has a viscosity ranging from 2–20 centistokes.

11. The superparamagnetic fluid according to claim 1, wherein said non-polar hydrocarbon oil carrier liquid is a poly (alpha olefin) oil having a viscosity ranging from 2–10 centistokes.

12. A method of making a superparamagnetic fluid in a stable colloid form comprising the steps of:

(a) providing an aqueous suspension of magnetic particles coated with at least one acid selected from the group consisting of an organic acid containing only carbon and hydrogen atoms in the chain connected to the carboxyl group, wherein the chain contains at least 19 carbon atoms, and an amino acid acylated with a fatty acid, provided that said organic and amino acids are branched, unsaturated, or both;

(b) separating said coated magnetic particles from water in said aqueous suspension;

(c) adding an ashless polymer which increases the viscosity of said superparamagnetic fluid; and (d) dispersing said coated magnetic particles in a non-polar hydrocarbon oil carrier liquid to form a superparamagnetic liquid.

13. The method according to claim 12, wherein said coated magnetic particles are separated from water in said aqueous suspension by adding a fugitive carrier to said coated magnetic particles in an amount sufficient to coagulate magnetic particles into a water repellant granular mass.

14. The method according to claim 13, further comprising rinsing said separated coated magnetic particles with water to remove by-product inorganic salts.

15. The method according to claim 12, wherein said organic acid is an aliphatic acid having at least 20 carbon atoms in a linear chain.

16. The method according to claim 12, wherein said organic acid is an aromatic acid having at least 20 carbon atoms in a linear chain.

17. The method according to claim 15, wherein said aliphatic acid is selected from the group consisting of erucic acid, gadoleic acid, 11-eicosenoic acid, cetoleic acid, brassidic acid, selacholeic acid, ximenic acid, lumequeic acid, arachidonic acid, methyl tetracosanoic acid, 20-ethyl docosanoic acid, 2-methyl behenic acid, 2-methyl arachidic acid, and 2-methyl cerotic acid.

18. The method according to claim 16, wherein said aromatic acid is selected from the group consisting of 4-(3-ethyl-8,13-dimethylhexadecyl) benzoic acid, 4-(9-octadecenyl) benzoic acid, 3-(8-hexadecenyl) benzoic acid.

19. The method according to claim 12, wherein said amino acid acylated with a fatty acid is represented by formula I:

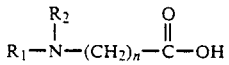

I wherein $R_1$ is a branched or unsaturated fatty acid radical derived from fatty acids with 12–22 carbon atoms; $R_2$ is $R_1$, a hydrogen atom, or an alkyl group with 1 to 22 carbon atoms; and n is an integer ranging from 1 to 11.

20. The method according to claim 19, wherein said fatty acid radical is derived from an acid selected from the group consisting of oleic acid, isostearic acid, erucic acid, linoleic acid and linolenic acid.

21. The method according to claim 19, wherein said amino acid acylated with a fatty acid is oleoyl sarcosine.

22. The method according to claim 12, wherein said ashless dispersant is used to increase the apparent colloid stability in a magnetic field gradient.

23. The method according to claim 12, wherein said non-polar hydrocarbon oil carrier liquid has a viscosity ranging from 2–20 centistokes.

24. The method according to claim 12, wherein said hydrocarbon oil carrier liquid is a poly (alpha olefin) oil having a viscosity ranging from 2–10 centistokes.

25. The method according to claim 12, further comprising the step of rinsing said coated magnetic particles with a water-miscible solvent prior to said dispersing step, wherein said solvent is selected from the group consisting of methanol, ethanol, propanol, isopropanol and acetone.

26. The method according to claim 12, further comprising the step of refining said superparamagnetic fluid by subjecting it to a magnetic field gradient to remove those particles which are too large to be stabilized in said magnetic field gradient.

27. A process for making a superparamagnetic fluid in a stable colloid form comprising:

(a) precipitating magnetic particles from an aqueous solution;

(b) forming coated magnetic particles by contacting said precipitated magnetic particles in an aqueous suspension with at least one acid selected from the group consisting of an organic acid containing only carbon and hydrogen atoms in the chain connected to the carboxyl group, wherein the chain contains at least 19 carbon atoms, and an amino acid acylated with a fatty acid, provided that said organic and amino acids are branched, unsaturated, or both;

(c) separating said coated magnetic particles from water by adding a fugitive carrier to said coated magnetic particles in an amount sufficient to coagulate said coated magnetic particles into a water repellant granular mass;

(d) rinsing said coated magnetic particles with water to remove by-product inorganic salts;

(e) adding an ashless polymer which increases the viscosity of said superparamagnetic fluid; and (f) adding said coated magnetic particles to a non-polar hydrocarbon oil carrier liquid or a mixture of a non-polar hydrocarbon oil carrier liquid and fugitive carrier to disperse said coated magnetic particles to form a superparamagnetic liquid.

28. The method according to claim 27, wherein said organic acid is an aliphatic acid having at least 20 carbon atoms in a linear chain.

29. The method according to claim 27, wherein said organic acid is an aromatic acid having at least 20 carbon atoms in a linear chain.

30. The method according to claim 28, wherein said aliphatic acid is selected from the group consisting of erucic acid, gadoleic acid, 11-eicosenoic acid, cetoleic acid, brassidic acid, selacholeic acid, ximenic acid, lumequeic acid, arachidonic acid, methyl tetracosanoic acid, 20-ethyl docosanoic acid, 2-methyl behenic acid, 2-methyl arachidic acid, and 2-methyl cerotic acid.

31. The method according to claim 29, wherein said aromatic acid is selected from the group consisting of 4-(3-ethyl-8,13-dimethylhexadecyl) benzoic acid, 4-(9-octadecenyl) benzoic acid, 3-(8-hexadecenyl) benzoic acid.

32. The method according to claim 27, wherein said amino acid acylated with a fatty acid is represented by formula I:

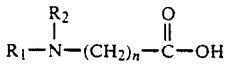

wherein $R_1$ is a branched or unsaturated fatty acid radical derived from fatty acids with 12–22 carbon atoms; $R_2$ is $R_1$, a hydrogen atom, or an alkyl group with 1 to 22 carbon atoms; and n is an integer ranging from 1 to 11.

33. The method according to claim 32, wherein said fatty acid radical is derived from an acid selected from the group consisting of oleic acid, isostearic acid, erucic acid, linoleic acid and linolenic acid.

34. The method according to claim 32, wherein said amino acid acylated with a fatty acid is oleoyl sarcosine.

35. The method according to claim 27, wherein said ashless polymer is used to increase the apparent colloid stability in a magnetic field gradient.

36. The method according to claim 27, wherein said non-polar hydrocarbon oil carrier liquid has a viscosity ranging from 2–20 centistokes.

37. The method according to claim 27, wherein said hydrocarbon oil carrier liquid is a poly (alpha olefin) oil having a viscosity ranging from 2–10 centistokes.

38. The method according to claim 27, further comprising the step of rinsing said coated magnetic particles with a water-miscible solvent prior to said dispersing step, wherein said solvent is selected from the group consisting of methanol, ethanol, propanol, isopropanol and acetone.

39. The method according to claim 27, wherein the ratio of said non-polar hydrocarbon oil carrier liquid to said fugitive carrier in said mixture is in the range of 10–80% by volume.

40. A superparamagnetic fluid consisting essentially of:

(a) a non-polar hydrocarbon oil carrier liquid;

(b) magnetic particles coated with at least one acid selected from the group consisting of an organic acid containing only carbon and hydrogen atoms in the chain connected to the carboxyl group, wherein the chain contains at least 19 carbon atoms, and an amino acid acylated with a fatty acid, provided that said organic and amino acids are branched, unsaturated, or both; and (c) an ashless polymer which increases the viscosity of said superparamagnetic fluid.

41. The superparamagnetic fluid according to claim 40, wherein said organic acid is an aliphatic acid having at least 20 carbon atoms in a linear chain.

42. The superparamagnetic fluid according to claim 40, wherein said organic acid is an aromatic acid having at least 20 carbon atoms in a linear chain.

43. The superparamagnetic fluid according to claim 41, wherein said aliphatic acid is selected from the group consisting of erucic acid, gadoleic acid, 11-eicosenoic acid, cetoleic acid, brassidic acid, selacholeic acid, ximenic acid, lumequeic acid, arachidonic acid, methyl tetracosanoic acid, 20-ethyl docosanoic acid, 2-methyl behenic acid, 2-methyl arachidic acid and 2-methyl cerotic acid.

44. The superparamagnetic fluid according to claim 42, wherein said aromatic acid is selected from the group consisting of 4-(3-ethyl-8,13-dimethylhexadecyl) benzoic acid. 4-(9-octadecenyl) benzoic acid, and 3-(8-hexadecenyl) benzoic acid.

45. The superparamagnetic fluid according to claim 40, wherein said amino acid acylated with a fatty acid is represented by formula I:

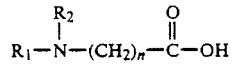

wherein $R_1$ is a branched or unsaturated fatty acid radical derived from fatty acids with 12–22 carbon atoms; $R_2$ is $R_1$, a hydrogen atom or an alkyl group with 1 to 22 carbon atoms; and n is an integer of 1 to 11.

46. The superparamagnetic fluid according to claim 45, wherein said fatty acid radical is derived from an acid selected from the group consisting of oleic acid, isostearic acid, erucic acid, linoleic acid and linolenic acid.

47. The superparamagnetic fluid according to claim 45, wherein said amino acid acylated with a fatty acid is oleoyl sarcosine.

48. The superparamagnetic fluid according to claim 40, wherein said non-polar hydrocarbon oil carrier liquid has a viscosity ranging from 2–20 centistokes.

49. The superparamagnetic fluid according to claim 40, wherein said non-polar hydrocarbon oil carrier liquid is a poly (alpha olefin) oil having a viscosity ranging from 2–10 centistokes.

* * * * *

UNITED STATES PATENT AND TRADEMARK OFFICE

CERTIFICATE OF CORRECTION

PATENT NO. : 5,064,550

DATED : November 12, 1991

INVENTOR(S) : John E. Wyman

It is certified that error appears in the above-identified patent and that said Letters Patent is hereby corrected as shown below:

Claim 1, column 13, line 56, after "fatty acid" insert --containing 12 to 22 carbon atoms--.

Claim 12, column 14, line 50, after "fatty acid" insert --containing 12 to 22 carbon atoms--.

Claim 22, column 15, line 38, change "dispersant" to --polymer--.

Claim 27, column 15, line 68, after "fatty acid" insert --containing 12 to 22 carbon atoms--.

Claim 40, column 17, line 15, after "fatty acid" insert --containing 12 to 22 carbon atoms--.

Signed and Sealed this

Sixteenth Day of March, 1993

*Attest:*

STEPHEN G. KUNIN

*Attesting Officer*

*Acting Commissioner of Patents and Trademarks*